United States Patent [19]

Grossi et al.

[11] 4,012,727

[45] Mar. 15, 1977

[54] ALARM CONTROL SYSTEM

[75] Inventors: Benedetto Grossi, Stanford; Ignas Budrys, Bethel, both of Conn.

[73] Assignee: General Signal Corporation, Rochester, N.Y.

[22] Filed: May 21, 1975

[21] Appl. No.: 579,335

[52] U.S. Cl. ..... 340/213 R; 340/409

[51] Int. Cl.[2] ..... G08B 25/00

[58] Field of Search ..... 340/213 R, 213.1, 213.2, 340/214, 276, 287, 292, 313, 314, 409

[56] References Cited

UNITED STATES PATENTS

| | | | |
|---|---|---|---|
| 3,550,111 | 12/1970 | Ervin | 340/276 |
| 3,854,127 | 12/1974 | Damon | 340/213.2 |

*Primary Examiner*—Alvin H. Waring
*Attorney, Agent, or Firm*—Milton E. Kleinman; John Ohlandt

[57] ABSTRACT

A flexible, expandable alarm control system in which varying combinations of functional circuit blocks or modules can be selected and connected in positions on a control panel by the customer or user of the system. Thus, the system can be modified to satisfy changing functional requirements by substitution of modules; furthermore, it can be expanded by adding functional modules to a given control panel or by extending the system to auxiliary control cabinets in which more circuitry can be mounted.

14 Claims, 18 Drawing Figures

FIG. 6

| ITEM NO. | SYSTEM REQUIREMENTS | A1 | A2 | A3 | B1 | B2 | B3 | B4 | C1 | C2 | C3 | REC 1 | REC 2 | REC 3 | REC 4 | REC 5 | SIG 1 | SIG 2 | SIG 3 | SIG 4 | K1 |
|---|---|---|---|---|---|---|---|---|---|---|---|---|---|---|---|---|---|---|---|---|---|
| 1 | ALARM INITIATING CIRCUIT, CLASS "B" (NORM, OPEN ALARM DEVICES) | | | | | | | | | | | X | | | | | | | | | |
| 2 | ALARM INITIATING CIRCUIT, CLASS "B" (IONIZATION DEVICES) | | | | | | | | | | | | X | | | | | | | | |
| 3 | ALARM INITIATING CIRCUIT, CLASS "A" (NORM. OPEN DEVICES) | | | | | | | | | | | | | X | | | | | | | |
| 4 | ALARM INITIATING CIRCUIT, CLASS "B" (NORM. OPEN DEVICES) LONG LINE | | | | | | | | | | | | | | X | | | | | | |
| 5 | ALARM INITIATING CIRCUIT, CLASS "A" (IONIZATION DEVICES) | | | | | | | | | | | | | | | X | | | | | |
| 6 | VIBRATING SIGNALS, PARALLEL CLASS "B" WITH TIME LIMIT CUTOUT | | | | X | | | | | | | | | | | | X | | | | |
| 7 | VIBRATING SIGNAL, PARALLEL, CLASS "A" WITH TIME LIMIT CUTOUT | | | | X | | | | | | | | | | | | | X | | | |
| 8 | VIBRATING SIGNAL, PARALLEL, CLASS "B" WITH CONTINUOUS ALARM | | | | | | X | | | | | | | | | | X | | | | |
| 9 | VIBRATING SIGNAL, PARALLEL, CLASS "A" WITH CONTINUOUS ALARM | | | | | | X | | | | | | | | | | | X | | | |
| 10 | SINGLE STROKE SIGNALS, PARALLEL, CLASS "B" WITH MARCH TIME ALARM | | | | | X | | | | | | | | | | | X | | | | |
| 11 | SINGLE STROKE SIGNALS, PARALLEL, CLASS "A" WITH MARCH TIME ALARM | | | | | X | | | | | | | | | | | | X | | | |
| 12 | SINGLE STROKE DC SIGNALS, SERIES, 2.6 TO 24 VOLTS, CLASS "B" WITH MARCH TIME ALARM | | | | | X | | | | | | | | | | | | | X | | |
| 13 | SINGLE STROKE DC SIGNALS, SERIES, 20 TO 120 VOLTS, CLASS "B," WITH MARCH TIME ALARM | | | | | | | X | | | | | | | | | | X | | | |
| 14 | ALARM OPERATED AUX. CONTACTS | | | | | | | | | | | | | | | | | | | | X |
| 15 | REMOTE STATION TIE | | | | | | | | X | | | | | | | | | | | | |
| 16 | STANDBY POWER | X | | | | | | | | | | | | | | | | | | | |

ALARM CONTROL SYSTEM

BACKGROUND, OBJECTS AND SUMMARY OF THE INVENTION

The present invention pertains to an alarm control system and, more particularly, to a system that can be modified and expanded at any time by the customer or user. The invention particularly relates to a fire control system in which a variety of initiating and signalling circuits or the like can be changed in accordance with the customer's new requirements and by a suitable implementation of the control panel, the added or modified initiating circuitry can be connected appropriately to selected internal circuitry on such control panel.

A particularly vexing problem has existed over many years in connection with alarm control systems and particularly those adapted to provide fire alarm or other emergency indications. The customer at the time of initial installation may not, for example, appreciate how extensive a system he may later require and is often compelled to purchase initially a system that is inadequate for future purposes because it does not permit him to vary significantly the internal control panel circuitry so as to take care of his new needs as these occur.

Accordingly, it is a primary object of the present invention to provide an alarm control system that is virtually universal in its application, particularly with regard to expansion in handling a variety of fire alarm initiating and signalling circuits.

Another object of the invention is to enable a customer to substantially design his own system, that is, to permit the user to "customize" the system and adapt it to his expanding or varying needs and purposes.

The above recited primary objects are fulfilled and implemented in accordance with a basic feature of the present invention. This feature contemplates a unique arrangement on a control panel within the cabinet housing the essential central equipment conventionally furnished with a system of this character. The control panel is so arranged that a number of kinds and types of functional blocks or modules can be moved into convenient spaced slots assigned to them on the control panel. These functional modules are very easily slid into place and are provided at their rear ends with suitable receptacles adapted to receive a corresponding plurality of pins on an assembly attached to the control panel.

A variety of these functional modules are furnished to a customer when he purchases the alarm control system and he can add to his initial set as dictated. Thus, the customer can utilize any combination of these functional modules in accordance with changes in the requirements of his system; that is to say, he can remove modules from predetermined slots or areas and substitute other functional modules therein. He can also expand the system by adding functional modules to slots not previously utilized. When a block or module of a different kind is substituted for an original module, it is sometimes required that the customer change the field wiring connections to the terminal block associated with the particular slot location.

In addition to the provision for selectivity in respect to the functional circuit modules, the customer can also adjust to varying signal current and power supply requirements by substitution of different so-called "common control" modules which are used only for the purpose of permitting variation in these parameters.

A further feature of the present invention resides in the provision for expanding the system beyond the initial five circuits, that is, the functional circuits furnished with a basic system. This is done by simple interconnection from a control cabinet to an adjoining similar control cabinet in which an additional control strip, having provision for receiving additional functional modules, is mounted.

Other and further objects, advantages and features of the present invention will be understood by reference to the following specification in conjunction with the annexed drawings, wherein like parts have been given like numbers.

DESCRIPTION OF THE DRAWINGS

FIG. 6 is a selection chart normally used by the customer for selecting the various components of an alarm system;

DESCRIPTION OF PREFERRED EMBODIMENT

Figure 1:
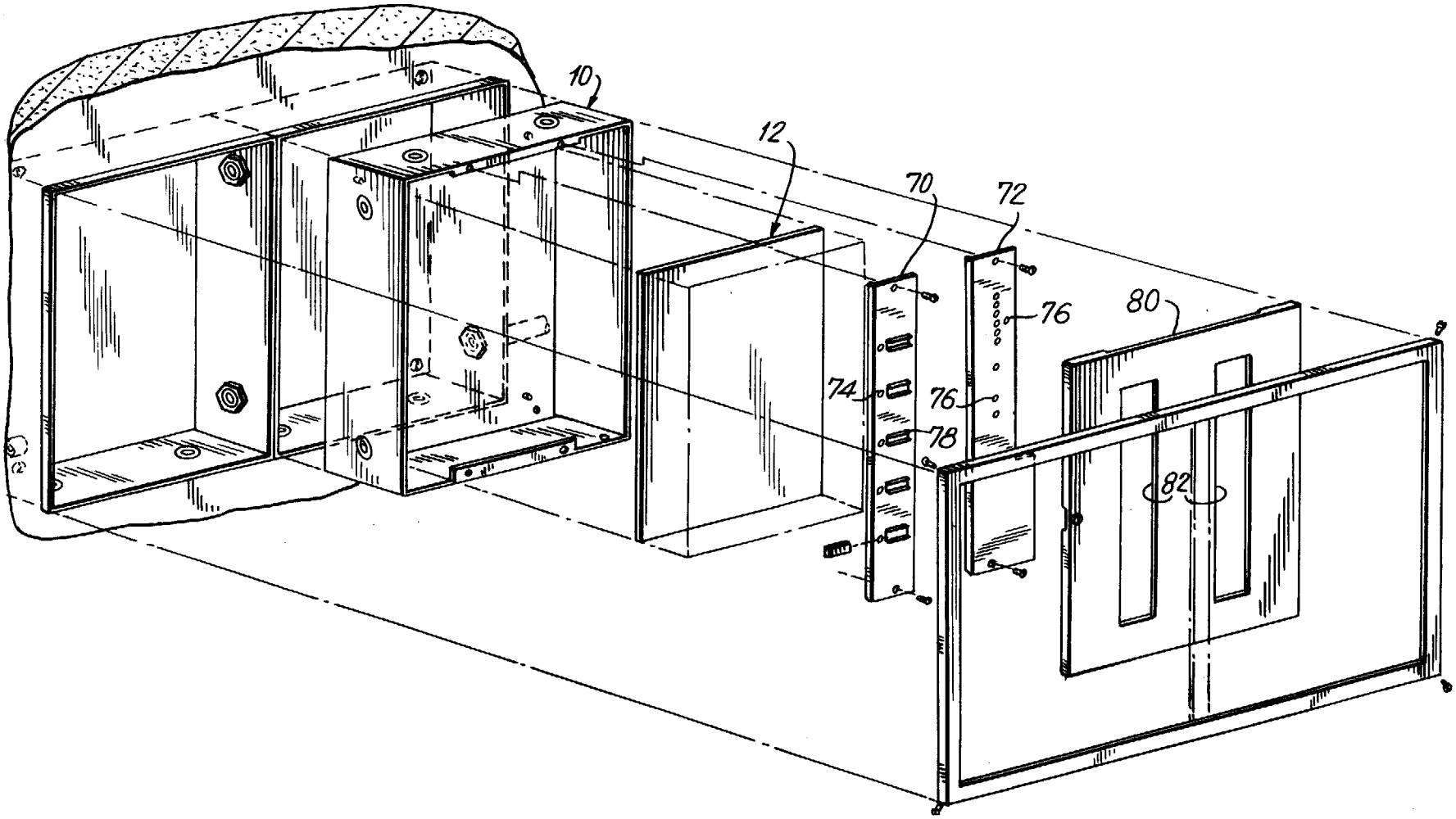
FIGS. 1 and 1A are exploded views of the entire control cabinet in accordance with a preferred embodiment of the alarm control system of the present invention.
Figure 2:
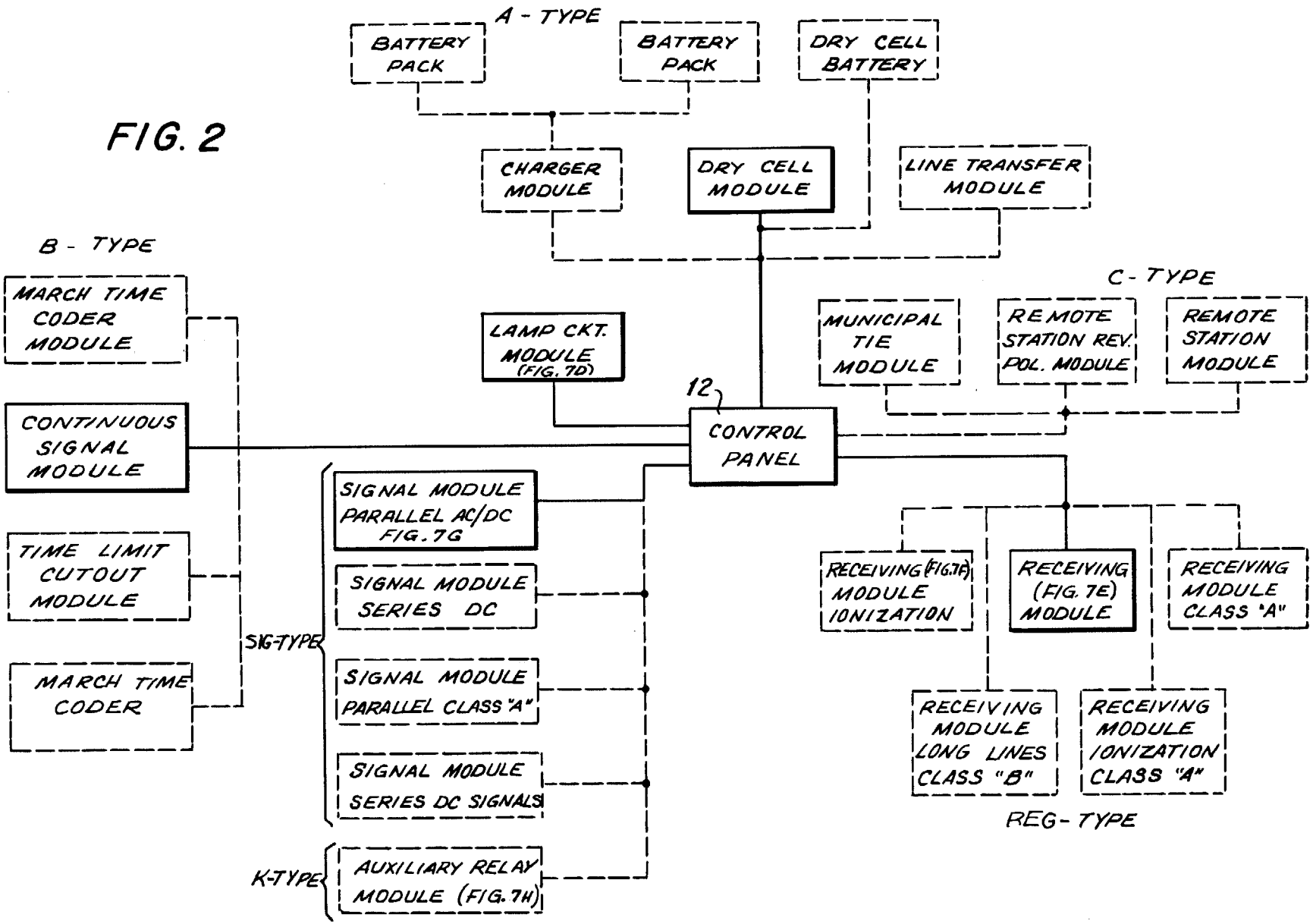
FIG. 2 is a block system diagram illustrating the essential elements for an extremely simple system and a much expanded form of that system.
Figure 1A:
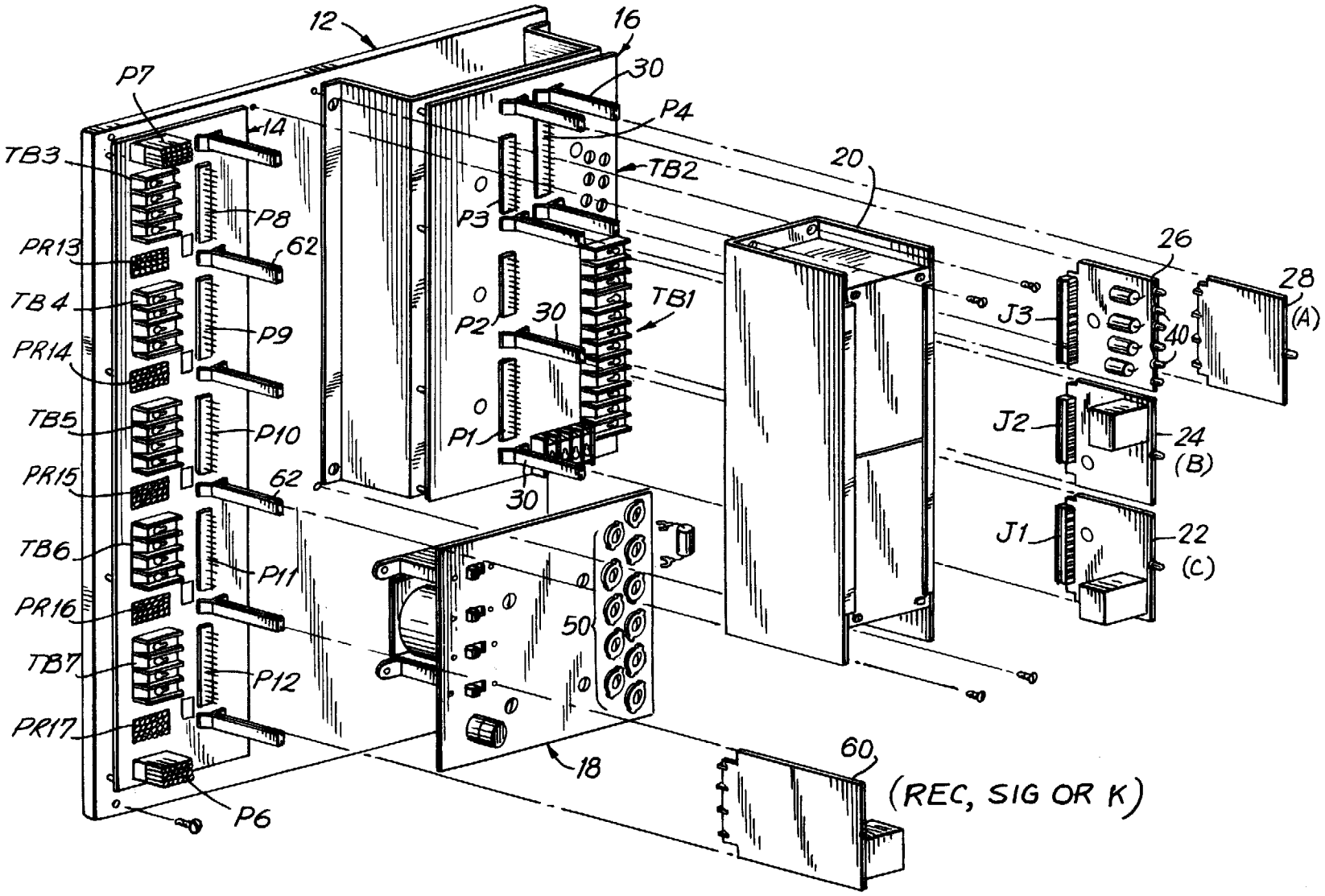

Referring now to the preferred embodiment of the system as seen in FIGS. 1–7, particular reference will be made for the moment to FIGS. 1 and 1A in which exploded views are presented of the equipment for monitoring various emergency conditions in an alarm control system. It will be made clear hereinafter that a number of alarm responding and alarm indicating circuits are connected from different locations or zones to this system. As will appear, common letter and numeral designations will be applied to similar parts, especially those may be substituted one for another in connecting to common circuitry.

At the control station a control cabinet 10 is provided, suitably mounted to a wall or the like. Within this cabinet there is housed a control panel 12 to which are secured a functional circuit strip 14, a signal and power control (or common) circuit strip 16, and a power and switch circuit assembly 18 (FIG. 1A). A battery pack 20 is shown as illustrative, being adapted to be utilized in particular systems to be described.

The common circuit strip 16 is provided with four individual pin assemblies P1, P2, P3 and P4, each of which is adapted to receive the corresponding receptacles J1, J2 and J4 of "common control" modules 22, 24 and 28, respectively, and the receptacle J3 of a lamp circuit module 26. These common control modules will be referred to hereinafter as A, B or C type modules, these being connectable into the system to satisfy various signal current and power supply requirements. It will be seen that the top and bottom edges of each of the modules 22–28 are adapted to be received between the spaced solts 30 on the strip 16.

A particular module 22 is adapted to contain a variety of circuits of the C type, these being generally denominated "remote station module". In this regard, see FIG. 3 on the left where the pins of the pin assembly P1 are illustrated, these pins being contacted by the receptacles J1 on the module 22. The particular C circuit to be employed is usually selected by the customer or user. A selection chart (see FIG. 6) includes column headings C-1, C-2 and C-3 which refer to particular C circuits. It will be appreciated from the chart that, as an example, one of these (C-1) is used in conjunction with a particularly required remote station tie (item 15 in the left-most column of the chart). Only one of these particular C circuits is illustrated, in FIG. 7C, this being the C-1 circuit.

Similarly, B type circuits, which are usually selected by the customer, are provided on a moduel 24 and are to be engaged with pin assembly P2. These are generally designated "signal control modules", one of the circuits thereof being illustrated in FIG. 7B.

A type circuits, usually selected by the customer, are provided on module 28 and are to be engaged with pin assembly P4. These are designated "auxiliary power modules", one of them being illustrated in FIG. 7A.

Figure 3:
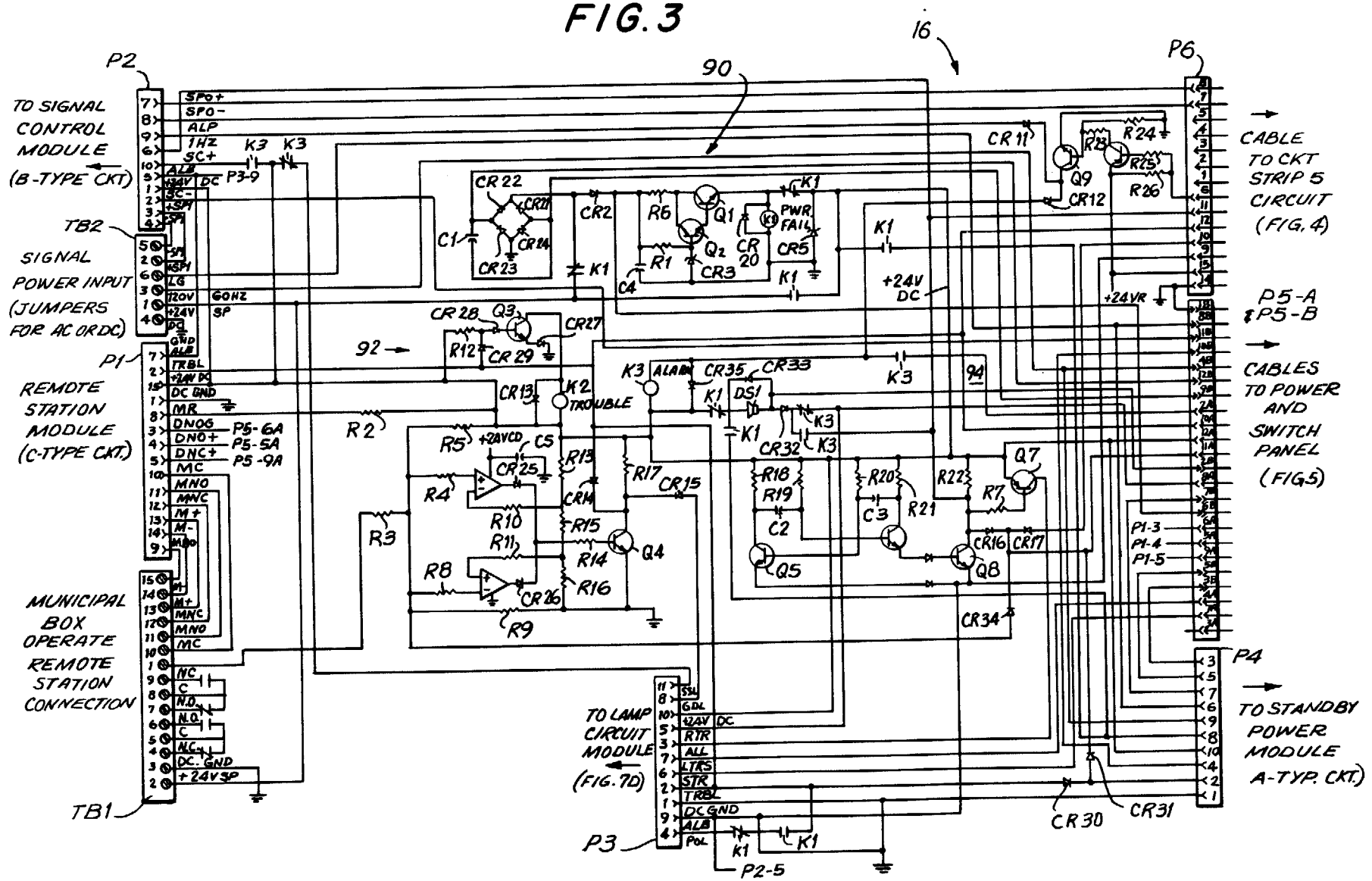
FIG. 3 is a schematic diagram for the control panel in the system of the present invention.

The electrical interconnections can be understood by reference to FIG. 3 in which that schematic diagram of the control panel 12 illustrates, at the top left, the connection of the B type circuits of module 24 to the pin assembly P2 and, at the lower right corner, the connection of the A type circuits of the module 28 to the pin assembly P4. It will be seen from the chart of FIG. 6 that the several B type circuits, that is, B1, B2 and B3 are used in connection with required items 6, 7, 8, 9, 10, 11, 12 and 13; whereas the A type circuits, A1, A2, A3, also seen on the chart of FIG. 6, are used in conjunction with various kinds of stand-by power (items 24, 25, 26 and 27).

Figure 7A:
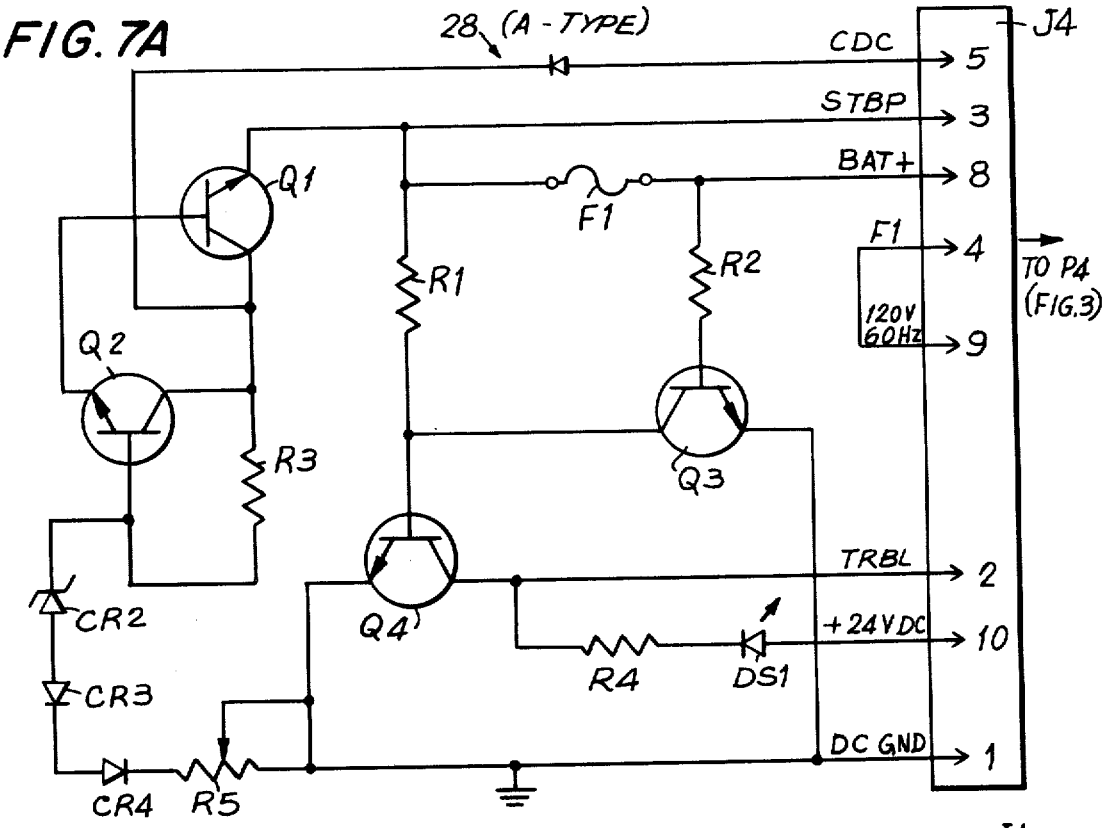
FIG. 7A is a schematic diagram of an A-type circuit module.
Figure 7C:
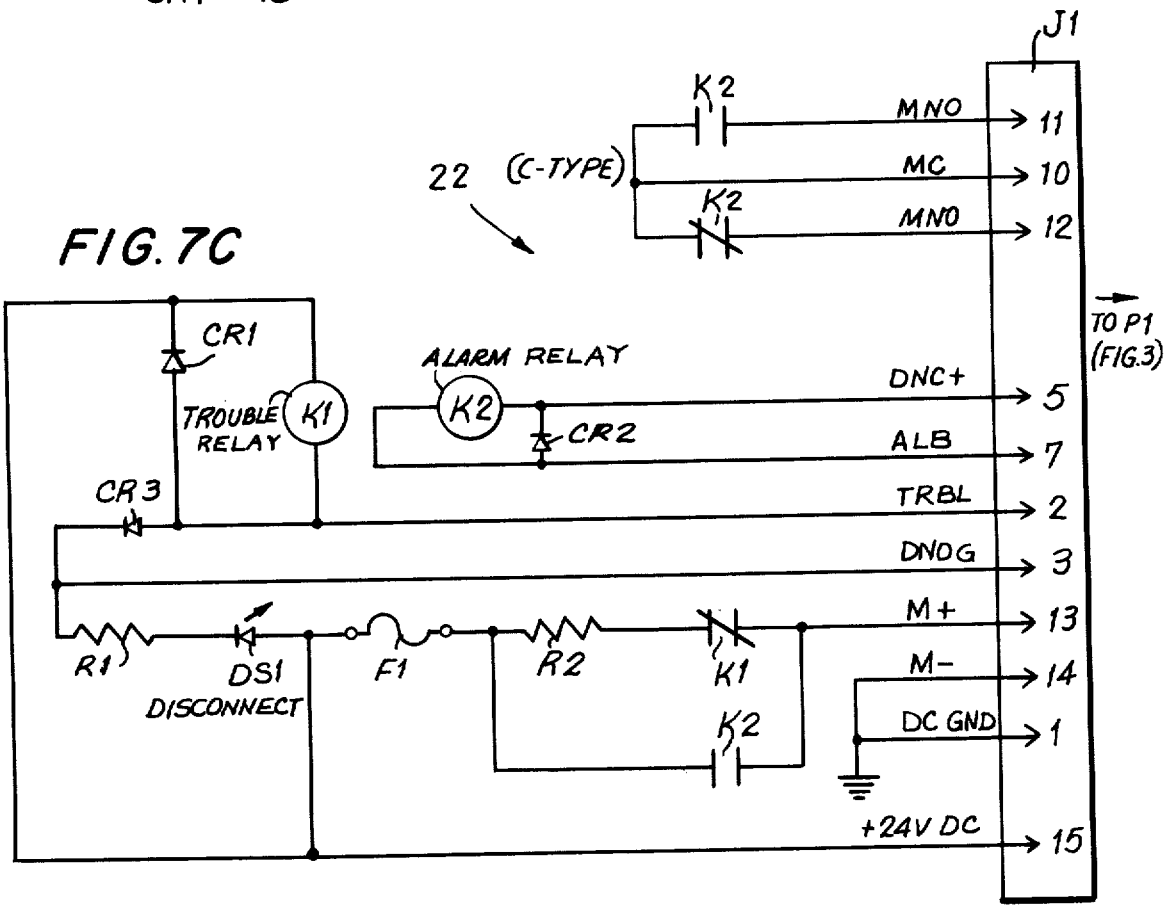
FIG. 7C is a schematic diagram of a C-type circuit module.
Figure 7B:
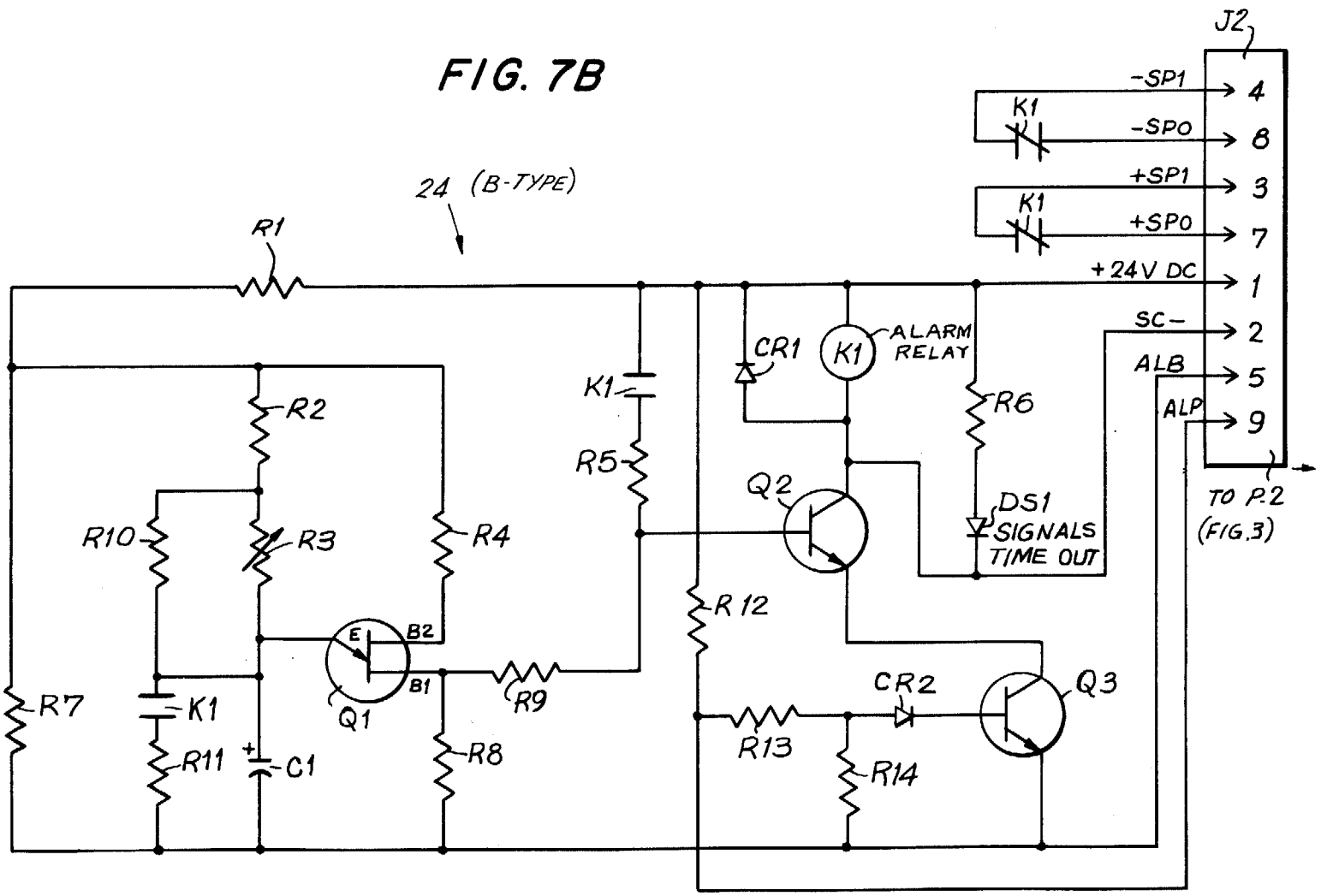
FIG. 7B is a schematic diagram of a B-type circuit module.
Figure 7D:
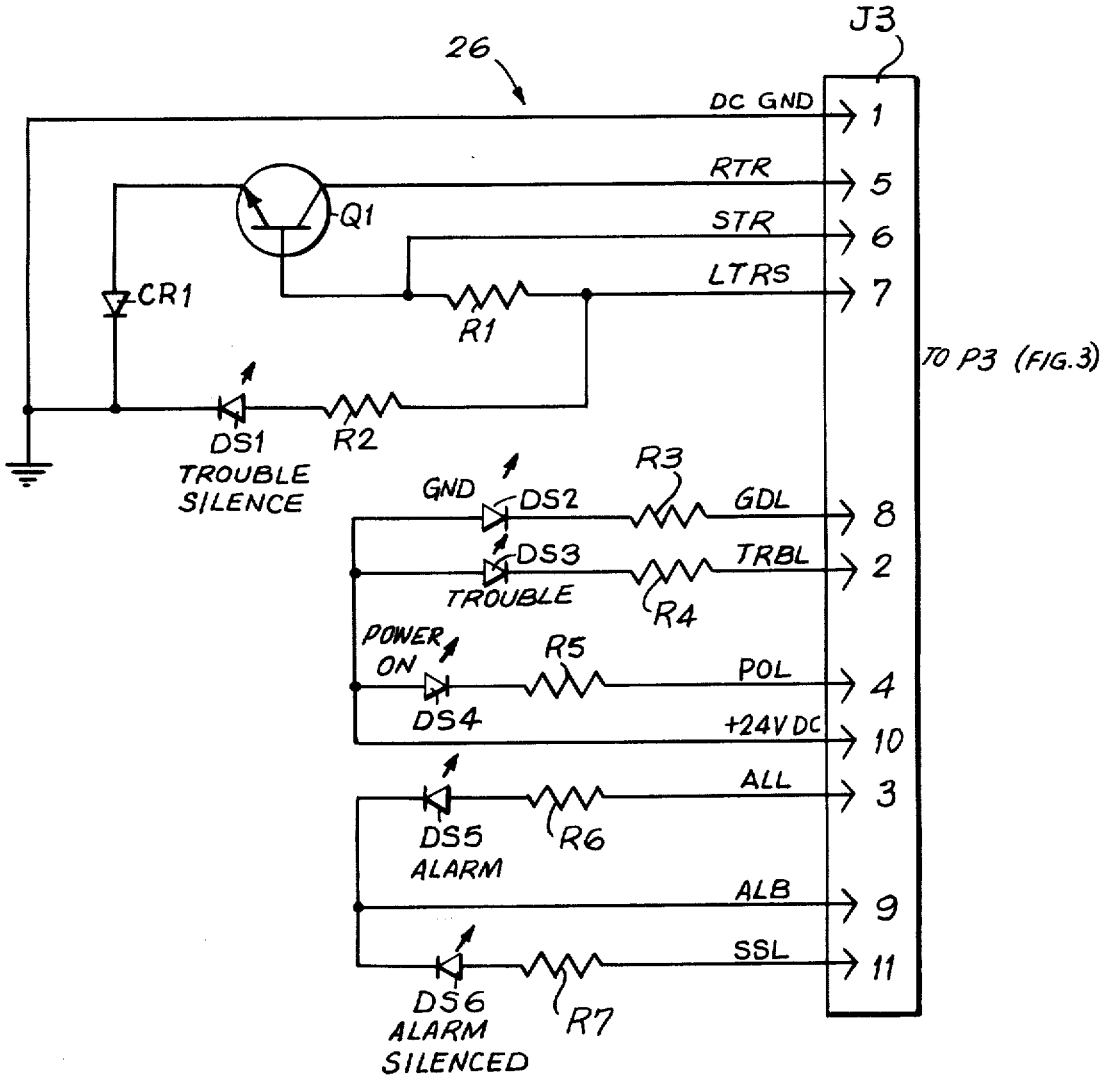
FIG. 7D is a schematic diagram of a lamp circuit module.

The fourth circuit module 26 in the group of four modules 22–28 is a special lamp circuit module and it will be seen that a series of six lights or lamps 40 are provided at the outer or right end of this module. The circuit configuration of this module 26 can be appreciated by reference to FIG. 7D in which a jack assembly J1 is adapted to fit onto the pin assembly P3. The lamps 40 of this series are light emitting diodes, DS1–DS6, as seen in FIG. 7D, such light emitting diodes being used to indicate a variety of operating conditions. For example, the light emitting diode DS4 when illuminated continuously indicates that power is on, all other light emitting diodes being normally "OFF". The transistor Q1 is normally OFF.

When any trouble occurs in the system the lamp circuit module 26 will indicate such trouble. This occurs because the TRBL bus will be activated by any system trouble and as a consequence the light emitting diode DS3 will illuminate continuously. In particular, if there is a ground fault on the chassis, the GDL line will activate and transmit its signal to the TRBL bus. The light emitting diodes DS2 and DS3 will both be illuminated continuously and the trouble buzzer 41 (FIG. 3) will sound. In the event that the trouble is silenced by switch S4 (FIG. 5) then the STR and LTRS lines will be activated. The light emitting diode DS1 will then illuminate continuously in addition to DS2 and DS3 and the buzzer will be silenced. However, when the system's troubles disappear the STR lines deactivates thereby turning transistor Q1 "ON". Lamps DS2 and DS3 will go out and buzzer will sound. Line RTR will be activated, thus providing a ring-back signal to the common control. Setting TRBL silence switch to normal will extinguish DS1 and silence the buzzer. Should AC power fail, the POL line will be deactivated thereby turning light emitting diode DS4 OFF.

In contrast to the normal operating condition or trouble condition, a further condition called the alarm condition will occur whenever an emergency or alarm eventuates. As a result, an alarm command will activate the ALL line or bus and the ALB bus. Consequently, the light emitting diode DS5 will be illuminated, flashing at approximately the rate of 2 Hz and buzzer will sound at the same rate. When the alarm silence switch has been actuated, the SS line will be activated, the buzzer will be silenced, but the lamps will remain flashing until the system is reset.

Referring back to FIG. 1, it will be seen that the common strip 16 has provision for the mounting of serveral terminal boards TB1 and TB2. As can be seen at the upper left in FIG. 3, the terminal board TB2 is provided with a plurality of screw terminals 1–6 to which appropriate connections are made from the components within the circuitry shown in FIG. 3 or to appropriate pin terminals on the pin assembly P2, shown immediately above TB2. Similarly, suitable connections are made from TB1 at the lower left from FIG. 3 to components within the control panel schematic seen in FIG. 3, and also to pin assembly P1 immediately above TB1.

Figure 4:
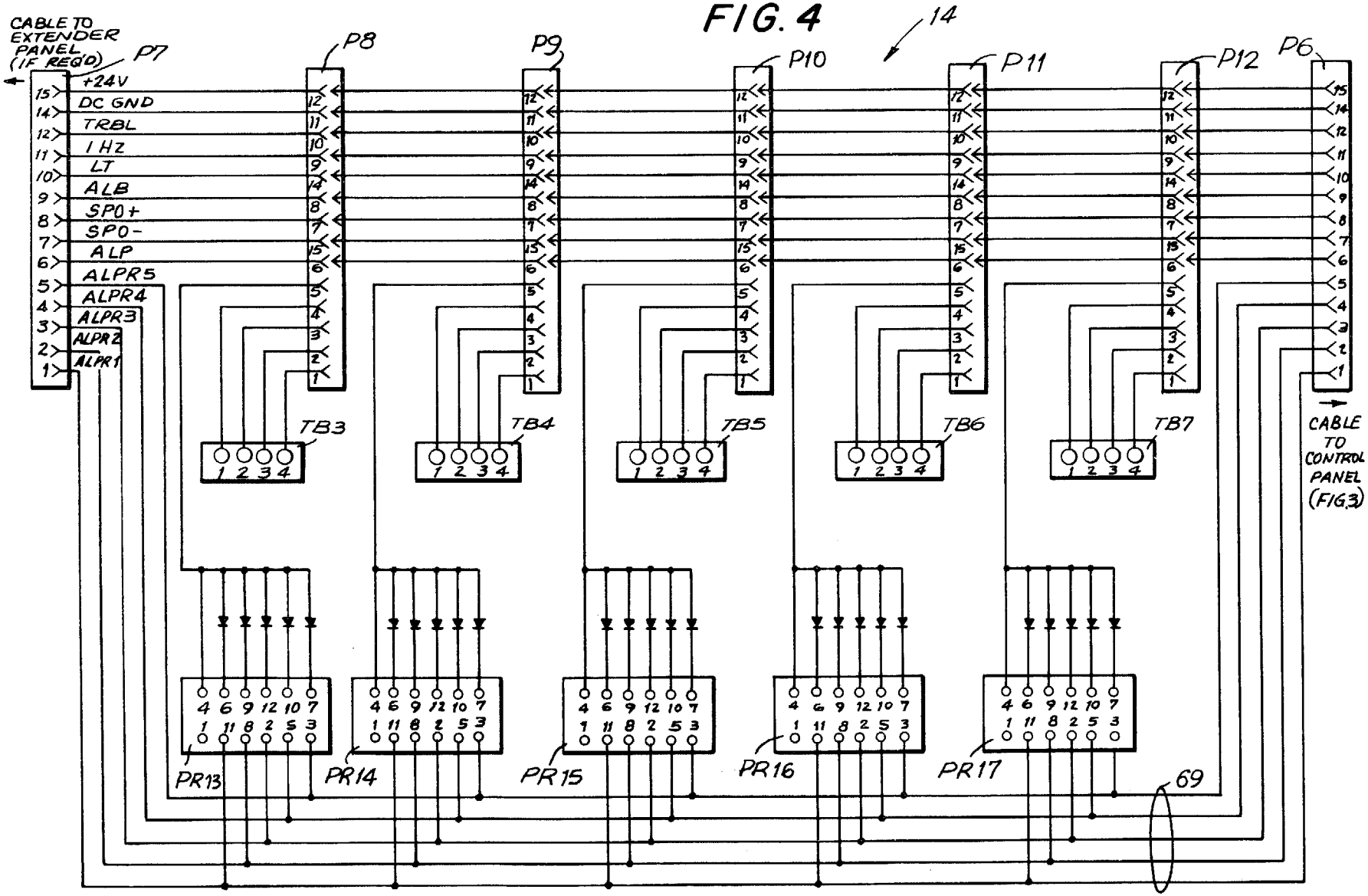
FIG. 4 is a schematic diagram which illustrates a five curcuit-strip adapted to receive the various functional circuit modules, such strip being programmable as to each module.

It should be noted in connection with FIG. 3 that, in addition to the pin assemblies P1–P4 and the terminals TB1 and TB2 already discussed, this figure also indicates cable connectors which extend, for example, from the upper left corner, designated P6, which connects to the same designated cabled connector at the upper right in FIG. 4. Also, it will be understood that the additional cable connections designated P5-A and P5-B are effective to connect with the circuitry seen in FIG. 5, being indicated on that figure with the same designation.

Figure 5:
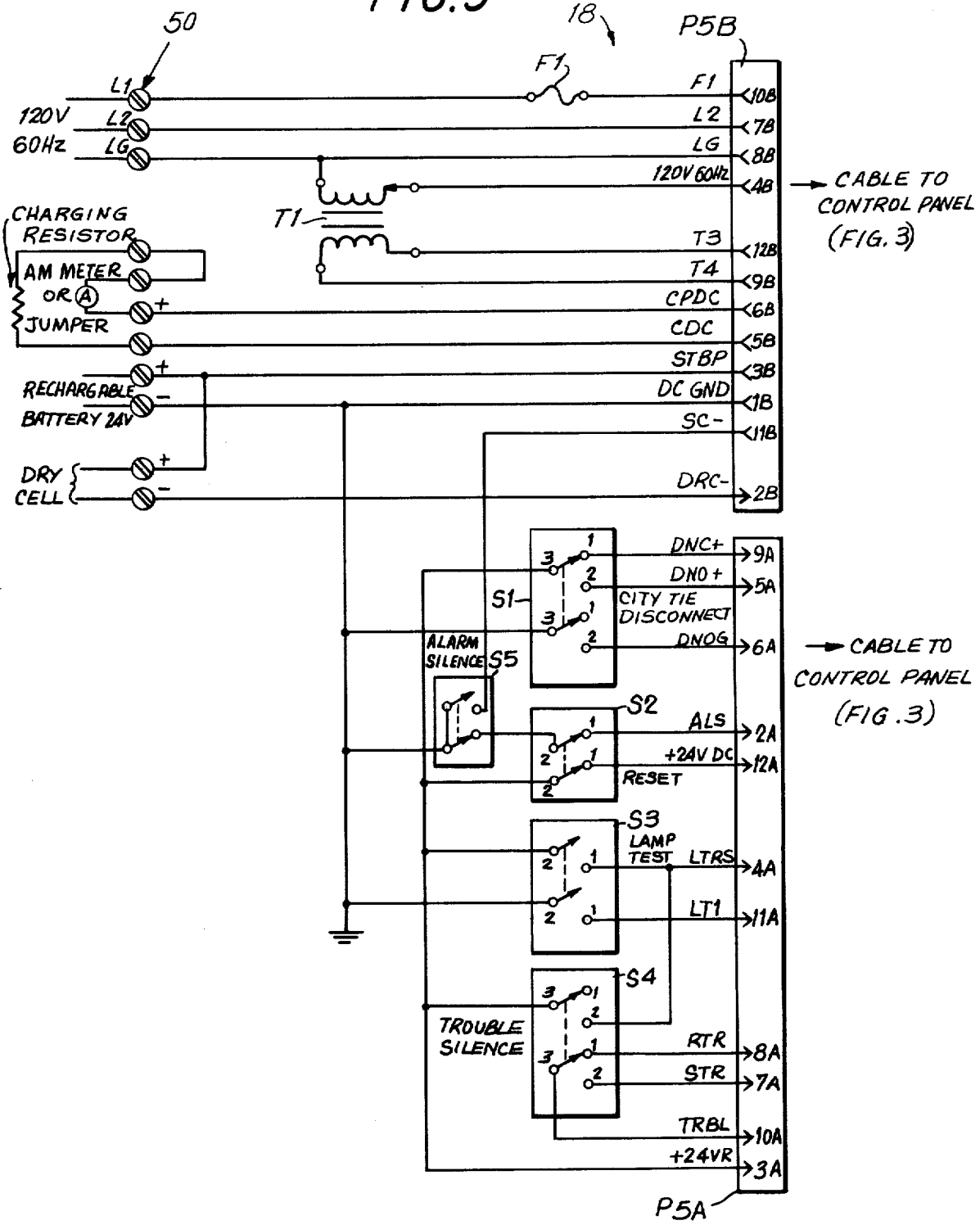
FIG. 5 is a schematic diagram of the power and switch circuitry which is adapted to be connected to the control panel circuitry.

These cable connections are not seen on the panels as depicted on FIG. 1. However, it will be appreciated that the components seen in the circuit diagram FIG. 5 are mounted on the back of the panel designated 18 and it will be noted that the screw terminals at the front of this panel 18 are the same as those seen at the upper left of FIG. 5, that is, the terminals for the 120 volt supply (L1, L2, LG) and the remaining eight terminals all of which are referenced by numeral 50.

Although the different terminals or connectors in different figures are not shown in consecutive order from top to bottom, it will be appreciated that the same terminals or pins and corresponding receptacles bear the same numerals. Thus, it will be seen referring to cable connectors P5A and P5B in FIG. 5, and taking the particular terminals 4B and 8B as an example, these terminals connect to like connector parts, either male or female, on the connectors P5A and P5B in FIG. 3 so that, for example, 120 volt 60 Hz is connected to 4B and the LG line or bus in connected to 8B in both instances.

Referring again to FIG. 1, there will now be described the functional circuit module arrangement in accordance with the present invention. This arrangement is seen on the left side of the control panel 12 and designated strip 14. As was the case before, i.e., with the common control or A, B and C modules already described, a variety of modules are exemplified by the single module 60 seen in FIG. 1 (in the middle of that view of the components). A number of these modules 60 are adapted to be selectively fitted onto the several pin assemblies P8–P12 (see also FIG. 4) and to have their top and bottom edges held within slots 62 outstanding from the strip 14. Associated with these modules 60, as was the case before with the signal and power control modules, are a number of terminal blocks TB3, TB4, TB5, TB6 and TB7, respectively. These particular terminal boards or blocks serve the purpose of enabling the customer to connect to particular alarm responding or indicating circuits at a variety of remote locations.

The interrelationship from the electrical standpoint between the aforesaid terminal blocks or boards TB3–TB7 and the pin assemblies P8–P12 can be understood by reference to FIG. 4. It will be noted that the terminals 6–15 on each of the pin assemblies P8–P12, as well as the end pin assemblies P6 and P7, are commoned together and that terminals or pins 1–4 on each of the pin assemblies P8–P12 are connected to the respective screw terminals 1–4 on each of the terminal blocks TB3–TB7.

It will also be seen that the lowermost five terminals on each of the assemblies P6 and P7 are connected together, the P7 pin assembly being adapted to be cable connected to an extender panel, as previously noted. Such an extension permits adding groups of five additional circuits and modules to the system.

It will also be noted that the fifth terminal on each of the pin assemblies P8–P12 is connected, for the purpose of programming, down to programming plugs designated PR13–PR17. Thus, a line connects, for example, the terminal 5 on assembly P12 to terminal 4 on programming plug 17 and through diode connection to each of terminals 6, 9, 12, 10 and 7 of the programming plug. Accordingly, any one of the aforesaid terminals on PR17 can be strapped or patched by a suitable patching plug or the like to any of the terminals 11 and 8, 2, 5, 3 seen at the bottom of PR17. The other programming plugs are similarly configured. As a result of the programming configuration, for example, one can select two receiving modules to be plugged into the pin assemblies P11 and P12, respectively; connect them by way of terminals 4 on PR16 and PR17 to separate ones of the common buses or lines 69 via, for example, lower terminals 11 and 8, respectively. Then, the S modules connected to pin assemblies P8–P10 can be suitably connected, in any combination desired, to the selected buses by means of the programming plugs PR13–PR15, respectively.

The various components already described are installed within the control cabinet 10 and the dead-front plate 70 and 72 are aligned appropriately and secured by means of screws or the like at the front of the cabinet. The various lamps 40 on the module 60 are so located that their light will shine through the hole or holes 74 in plate 70. Likewise, the lamps 40 of the modules 22–28 will align appropriately with the holes 76 and plate 72. Accordingly, when trouble or alarm conditions exist and the required lamps are giving their continuous or intermittent light, this will be observable at the front end of the cabinet. Also, it will be seen that rectangular opening 78 are also provided in plate 70 so that various indicia may be observed by an operator, whereby he may ascertain what particular alarm or trouble condition exists. The cabinet 10 is closed at the front end by the front cover 80 which is provided with rectangular openings 82 so that the various indicia may be observed.

CONTROL PANEL INTERNAL CIRCUITRY

Referring now to FIG. 3, the internal circuitry of that schematic diagram will now be described, the peripheral section, including the several terminal boards, the various pin assemblies and the cable connections having already been described. The circuit consists of three basic portions: the +24 volt DC regulated power supply generally designated 90, the ground detection portion generally designated 92, and the alarm flip-flop 94.

The DC power supply portion 90, when normally operated comprises the capacitors C1 and C4; the regulating diodes CR2, CR3, CR5, CR21, CR22, CR23 and CR24; the resistors R1 and R6 and the transistors Q1 and Q2.

The ground detection portion 92 of the circuit comprises the resistors R3, R4, R5, R9, R10, R11, R13, R15, R16, R14, R17; capacitor C5, transistor Q4; regulating diode CR25, CR26, CR14; and integrated circuit 1 comprising the pair of operational amplifiers. The IC1 outputs are normally LOW.

The alarm flip-flop 94 comprises the relay K3, resistors R7, R18, R19, R20, R21, R22, R23, R24, R25, R26; regulating diodes CR11, CR12, CR16, CR17, CR18, CR19, CR34; capacitors C2, C3; transistors Q5, Q6, Q7, Q8, Q9 and Q10. This portion of the circuit is normally deactivated.

In addition to the portions already mentioned there is a power failure relay K1, at the output of Q1, said relay being normally energized. There is also a trouble relay K2 which is normally energized.

Any trouble in the system will operate to activate the TRBL bus. As a result, transistor Q3 will turn OFF thereby deenergizing the K2 trouble relay. The buzzer 41 will sound continuously being activated by RTR, thus indicating trouble. The buzzer can be silenced by the trouble silence switch S4 (FIG. 5) which will deactivate the RTR line and transfer the trouble signal to STR. In addition, the LTRS line will activate to +24 volt DC.

In the event that there is a ground or there is voltage present on the isolated chassis, the ground detection circuit 92 will provide a signal via the GDL line and the trouble line, that is, the TRBL bus.

The ground detection circuit 92 operates because of the following: the R3, R4, R5, R8 and R9 junction is normally at about 12 volts. The comparators' (ICI) constant reference at the junction of resistors R10, R13, R15 is about 15 volts, whereas it is about 9 volts at the junction of R11, R15 and R16. Since the comparators' references are, respectively, higher and lower, the outputs will remain low. However, when the first named junction has a voltage rated in the constant reference voltage at the junction of R10, R13 and R15, or whenever it is lower than the constant reference voltage at the junction of R11, R15, R16, then one of the comparative outputs will go high. Consequently, transistor Q4 will then turn on, activating the GDL line and the TRBL bus. The buzzer 41 will sound continuously, thus indicating trouble. Should the AC power fail, the K1 relay will become de-energized thereby again activating the GRPL bus.

whenever this system's trouble disappears, assuming that the trouble silence switch S4 is in the silence position, the buzzer will sound continuously indicating that the system's trouble has been cleared. Moving this switch to its normal position will silence the buzzer.

Now assuming that an alarm condition is present in the system, then an alarm command is transmitted to the common control through ALP which turns transistor Q10 ON, which turns transistor Q9 ON thereby energizing the self-latching alarm relay K3. As a consequence, the ALB bus activates, providing a return for the alarm flip-flop circuit. The output stage of the flip-flop 94 provides a positive drive to transistor Q7 and a negative return to transistor Q8. Accordingly, the All and 1HZ lines activate. The buzzer 41 will sound at the approximate rate of 2 Hz and the buzzer can be silenced by activating the alarm silence switch S5 (FIG. 5) which will also de-energize relay K2 and the latched alarm relay K3. The system can be totally reset by activating the reset switch S2 and as a result the ALS and 24VR lines become momentarily interrupted.

All of the indicator lights or lamps 40 in the system, except those for the P1 and P2 locations on a common control, will undergo an illumination test by activation of the momentary lamp test switch, that is, switch S3 in FIG. 5. As a result, the LTRS, LT1 and LT lines will be activated and the ALB bus will activate through Q8, which in an open circuit configuration acts as a shunt resistor.

FUNCTIONAL CIRCUIT MODULES

Figure 7E:
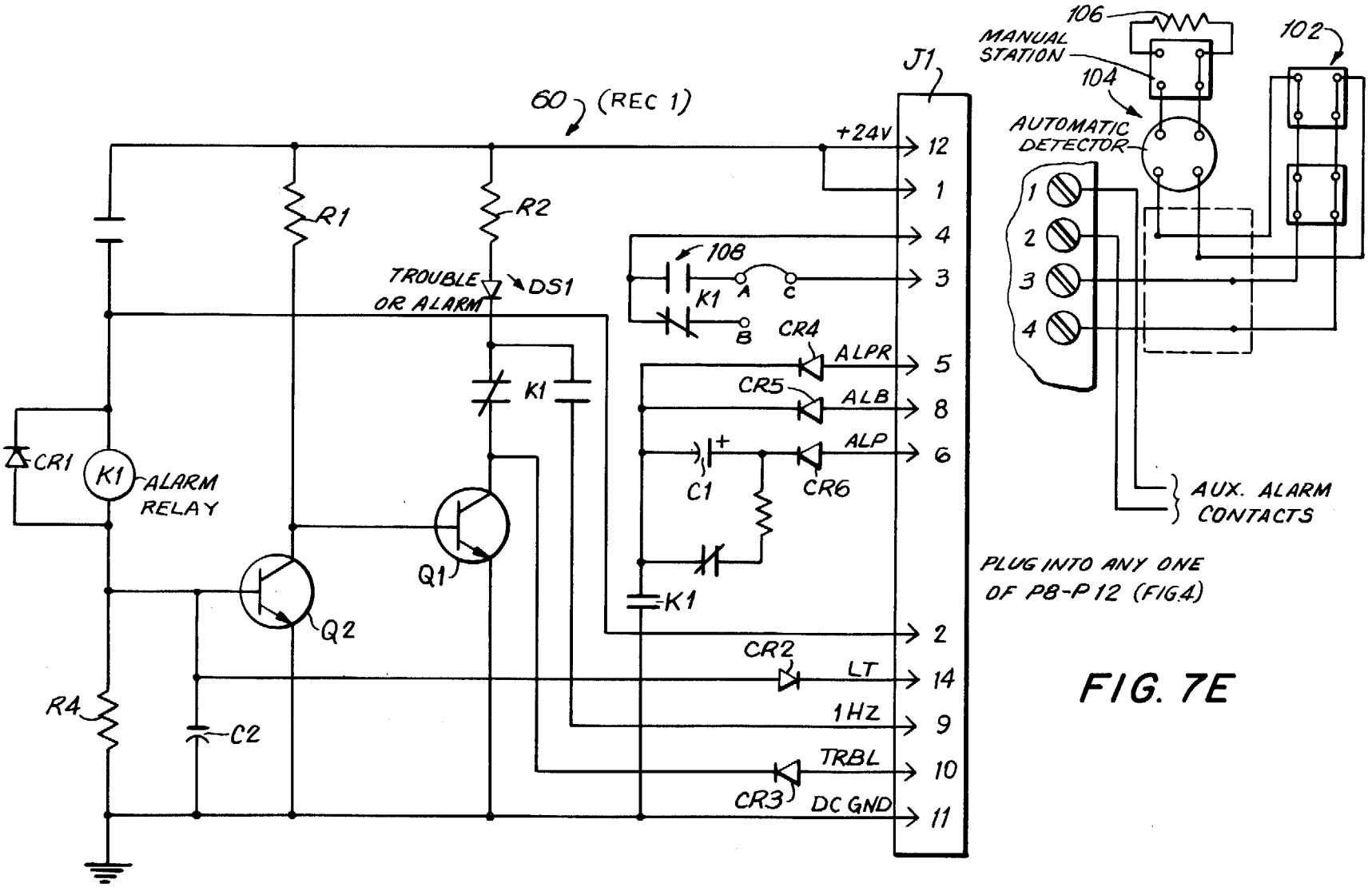
FIGS. 7E–7H are schematic diagrams of various functional circuit modules that are substitutable one for another and in any combination by connection to any of the appropriate pin assemblies on the control cabinet.
Figure 7F:
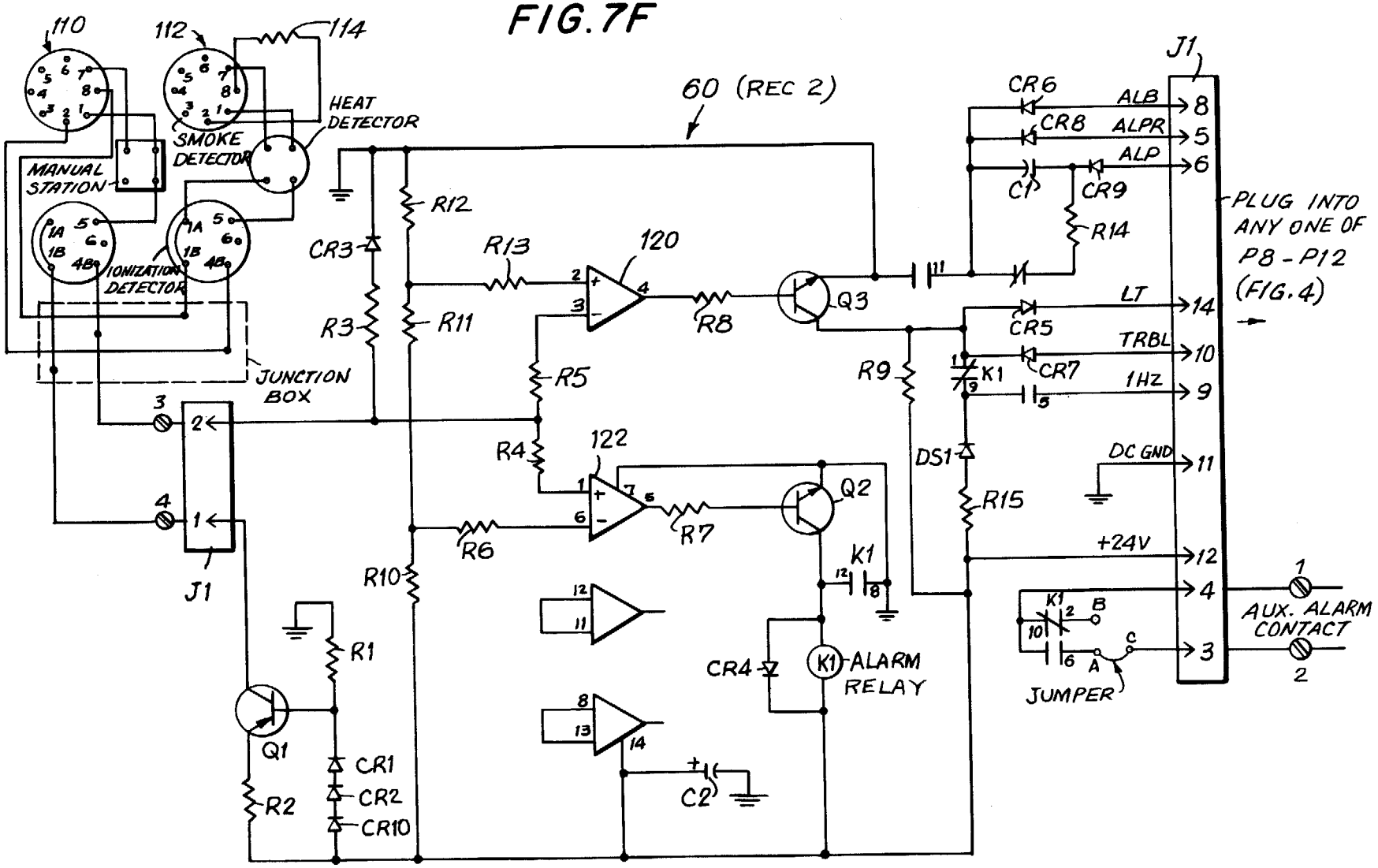

The functional circuit modules are those modules which are connected to alarm responding and indicating circuits and which can be organized in any combination by the customer or user in accordance with the expansion requirements of the customer's set up or system. Such functional modules are exemplified by the module 60 shown in FIG. 1A. These particular modules are given a functional designation REC (receiving module), SIG (signal module), or K (auxiliary relay module). Within each generic designation, for example for each REC module, there can be a variety of specific circuits. Referring to FIGS. 7E and 7F there are shown two kinds of receiving modules, the first of which seen in FIG. 7E is specifically designated REC1 and can be found on the chart of FIG. 6 (in the 11th column; required in the case of the use of item No. 1 in this system, that is, the first item in the first column, which is an alarm initiating or responding circuit, class B with normally open alarm devices.)

The normally open alarm devices as used in such alarm initiating circuit are seen connected at the upper right to the customer's terminals 1–4 in FIG. 7E.

As will be seen in FIG. 7E, there are provided pairs of alarm responding or initiating devices 105 connected in parallel and including an end of line resistor 106.

It will be noted that the auxiliary alarm contacts 108 seen in FIG. 7E are connected to receptacles 3 and 4, which connect to corresponding pins 3 and 4 of any one of the pin assemblies P8 through P12 and thence to the appropriate customer terminals, that is, to terminals 1 and 2 for connection to a fire equipment station or the like for indicating an alarm or emergency condition at such remote location.

Considering the operation of the system in connection with the receiving module depicted in FIG. 7E, that is, an REC1 module, supervisory current will flow through the end of the line resistor 106 by way of customer's terminals 3 and 4 and thence through the K1 relay and resistor R4, returning to ground. Consequently, transistor Q2 is maintained in the ON state which keeps transistor Q1 OFF. Therefore, trouble or alarm light emitting diode DS1 is OFF and the circuit is in the stand-by mode.

Now assuming, for example, that the supervisory current path just described is disrupted by an open circuit in the line, then the base current for transistor Q2 is zero and such transistor turns OFF. Transistor Q1 then turns ON through the resistor R1 path providing a ground for DS1 which illuminates continuously. On the other hand, should a short circuit cut across the end of the line, thereby increasing the current through it, the alarm relay K1 will energize and transistor Q2 will remain ON and transistor Q1 will remain OFF. However, capacitor C1 discharges to ground thereby providing a negative pulse to the bus ALP. Buses ALB and ALPR go down to ground. Consequently, the one Hz bus being active causes a flashing indication of diode DS1.

Referring now to FIG. 7F, there is depicted another receiving module similar to the one previously seen in FIG. 7E. However, here the receiving module, designated REC2, is for the purposes of detecting emergency conditions as sensed by ionization devices sensitive to smoke conditions and for initiating signals to give an indication of such emergency conditions at the control panel and at remote indicating stations. As before, the external circuit which does the sensing and initiates an alarm is extended out from customer's terminals 3 and 4 as seen on the left in FIG. 7F. Customer's terminals 1 and 2 are for the purpose of connecting, by way of receptacles 3 and 4 and the corresponding pins on any one of the pin assemblies, to the relay contacts K1 which are either normally open or normally closed as selected by the jumper.

Several pairs of devices 110 and 112 are seen connected in parallel and an end-of-line resistor 114 is connected to the line. Each of the groups of devices 110 and 112 is of course provided at a different area or zone where smoke or heat or other parameter is to be sensed.

The light emitting diode DS1 is normally OFF because the quiescent or supervisory current flowing through transistor Q1 and the end-of-line resistor 114 (by was of customer terminals 3 and 4) divides that resistor R3 providing a 2.0 volt reference at the junction of resistors R4 and R5. Since the constant reference voltage at the junction of resistors R11 and R12 is 0.6 volts and the voltage at the junction of resistors R10 and R11 is 3.0 volts, the outputs of comparators 120 and 122 are low, keeping transistors Q2 and Q3 OFF. The circuit is therefore in its stand-by mode.

However, if the supervised lines become open, the reference voltage at the junction of resistors R4 and R5 goes down to zero volts. Therefore the reference at the junction of R11 and R12 is graded, thereby causing the comparator to go high. As a result, transistor Q3 turns on and the light emitting diode DS1 is illuminated continuously. The trouble signal will be transmitted through TRBL bus to the common control.

When there is an alarm condition, that is to say, when one of the ionization devices or detectors senses smoke, the current through the line and through resistor R3 goes up, transistor Q1 acting as a current limiter. The reference at the junction of R4 and R5 goes above the constant reference at the junction R10 and R11. The comparator 122 goes high, turning transistor Q2 on.

Figure 7G:
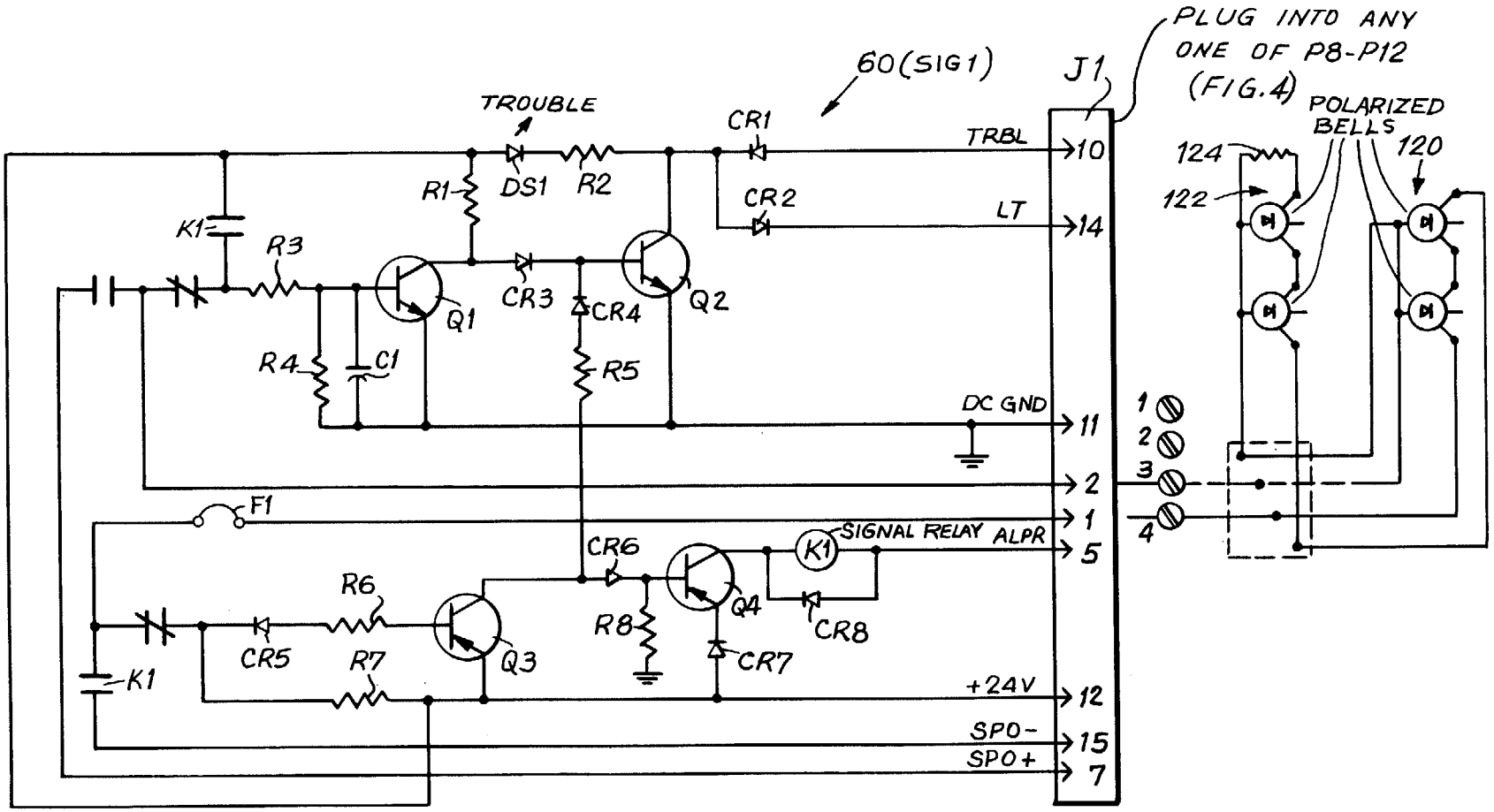

Referring to FIG. 7G, there will be seen another variety or kind of module 60, that is, what is termed an SIG1 module, which is constructed to provide signals to a plurality of sounding devices in parallel. As has been noted hereinbefore, jumpers are provided on the control panel so that the user may select the particular power supply to be used in conjunction with the signal module SIG1. Thus, the jumpers are appropriately manipulated on TB2 of control panel 12 (FIG. 3).

The required signal current is fed from customer terminals 3 and 4 seen on the right in FIG. 7G and extending out over suitable lines to pairs of devices 120 and 122. An end-of-line resistor 124 will also be seen.

Under normal or supervisory conditions for the circuit of FIG. 7G, supervisory current flows through resistor R7, the end-of-line resistor 124, and through R3 and R4 to ground. As a result transistor Q1 is maintained ON, and transistors Q2 and Q3 are maintained OFF with transistor Q4 forward biased. Trouble lamp DS1 is OFF and the circuit is in a stand-by mode.

Assuming now a trouble condition exists in the form of an open circuit, the current previously flowing through the described supervised line cannot find a ground return point. Therefore, transistor Q3 remains OFF, with transistor Q4 forward biased. Consequently, transistor Q1 turns OFF, thereby allowing transistor Q2 to turn ON, thus providing ground return for DS1 which illuminates continuously. The trouble signal will also be transmitted through TRBL bus (J1-10) to the common control. However, the trouble signal will be silenced if there is at the same time an alarm command on the ALPR bus (J1-5).

Now however, assume there is a trouble condition in the form of a short circuit. When this happens, the supervised lines short circuit and the supervisory current going through them increases, thereby causing transistor Q3 to turn ON. Transistor Q3 provides current to resistor R5 and diode CR4 that turns transistor Q2 ON. Consequently, diode DS1 will illuminate continuously. Transistor Q3 will turn off and transistor Q1 remian ON. The trouble signal will be transmitted through TRBL bus (J1-10) to the common control. Again, the trouble signal will be silenced if there is an alarm command on the ALPR bus (J1-5).

When there is an alarm condition, the incoming alarm command will activate the ALPR bus, and transistor Q4 will turn on through the signal relay coil K1 which will also be energized. The supervisory portion of the circuit will be isolated by the K1 contacts. The signal current will flow from SPO+ (J1-7) through fuse F1 thence through the signalling devices 120 and 122 (by way of J1-1 and J1-2) and return to SPO−.

Figure 7H:
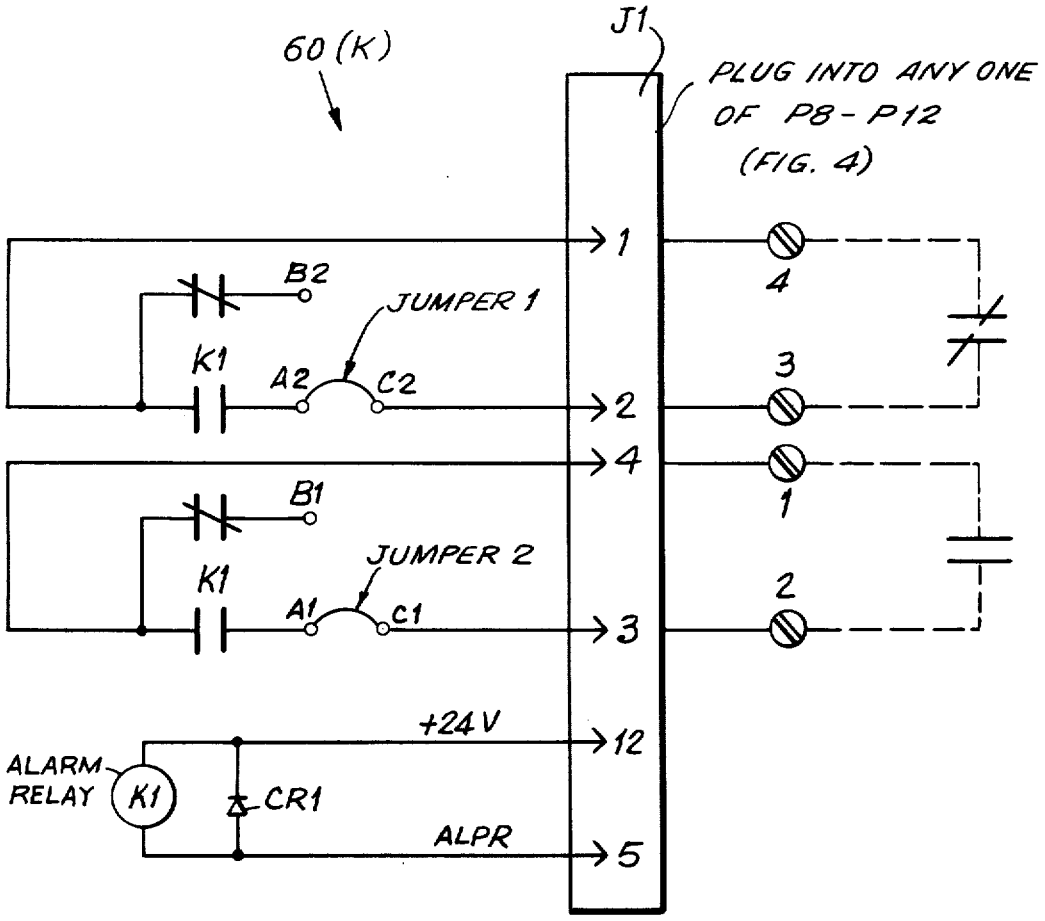

Another variety or type of module will be seen by reference to FIG. 7H in which an auxiliary relay module (K1) is depicted. As was the case before with the other modules, this module may be plugged into any one of the pin assemblies P8–P12 (FIG. 4).

The auxiliary relay circuit seen in FIG. 7H is an unsupervised circuit. It provides dry contacts for auxiliary functions. Thus, the de-energized relay K1 is connected to +24 volts awaiting an alarm command from the ALPR bus. Accordingly, whenever the alarm programmed bus ALPR becomes active, the auxiliary relay K1 becomes energized, thereby providing a contact reversal action depending upon the strapping configuration, that is, the use of the jumpers 1 and 2.

What has been disclosed herein is a unique alarm control system which permits for great flexibility in service. The customer or user of the system is able to exercise great control over the modification and expansion of the system and he can, in particular, utilize combinations of functional circuit modules, particularly those described above as modules REC, SIG and K and incorporate these as desired in his system. Although only a few different types of circuits have been specifically illustrated as examples of what can be done or what can be utilized, it will be apparent that additional circuits useful in future schemes yet to develop can as readily be implemented within the system.

Additionally, the modular concept in accordance with the present invention permits simplified programming of the receiving, signal auxiliary relay modules and allows for providing an alarm input that may be used for programming of signal zones.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. An alarm control system, comprising a control panel;

at least one alarm responding circuit having connected therein a plurality of alarm responding or initiating stations remotely located from said control panel for responding to an alarm condition;

at least one alarm indicating circuit having connected therein a plurality of alarm indicating stations remotely located from said control panel;

a common control circuit strip mounted on said control panel and having a plurality of kinds of common control circuit modules, including signal current and power supply control circuits, adapted to be connected to said common control circuit strip;

a functional circuit strip mounted on said control panel, and a plurality of kinds of functional circuit modules including at least receiving and signalling modules;

means for receiving said receiving and signalling modules in discrete connector areas on said functional circuit strip, including means for connecting terminals in common between all said connector areas and means for interconnecting said receiving and signalling modules through said strip selectively to each other and to said alarm initiating circuit and to said alarm indicating circuit respectively such that a receiving module can be substituted for a signalling module in a same given discrete connector area on said functional circuit strip.

2. A system as defined in claim 1, further including a plurality of groups of alarm indicating stations, and means for connecting said plurality of groups of alarm indicating stations to respective signalling modules so that selectively different signals can be transmitted to different ones of said groups of alarm indicating stations in response to the same or different alarm initiating devices.

3. A system as defined in claim 1, further including auxiliary relay modules.

4. A system as defined in claim 3, in which a plurality of receiving modules is included, at least one of which comprises a circuit having a common alarm and trouble lamp and including either a normally open or normally closed auxiliary relay contact and means for providing energy to said modules such that said alarm lamp flashes during the alarm mode until the system is reset and said lamp is illuminated steadily or continuously responsive to an open condition in the initiating circuit and continuing until the open condition is corrected.

5. A system as defined in claim 3, in which one of said signalling modules includes a control circuit providing for either DC or AC operation;

means for providing signal current such that an open or short circuit in the field wiring or a blown fuse on said module produces illumination of the trouble lamp on said module, and means for disconnecting said module automatically in the event of a field wiring short circuit.

6. A system as defined in claim 3, in which one of said auxiliary relay modules is operative responsive to an alarm condition to energize or de-energize remote electrical controls including means for selecting combinations of normally open and normally closed contacts.

7. A system as defined in claim 1, in which a series of connector assemblies are mounted on said functional circuit strip and also on said common control strip, and assemblies being engageable by a corresponding mating series of connector assemblies on said modules.

8. A system as defined in claim 1 in which programmable plug connections are provided for said functional circuit modules.

9. An alarm control system as defined in claim 1, in which said functional circuit strip includes a pin assembly in each of said discrete connector areas and each functional module has a mating receptable assembly;

common buses for interconnecting said pin assemblies on said circuit strip; and programming plugs connected to said common buses and to said pin assemblies such that a variety of said functional modules can be selectively connected to said buses and to each other whereby a plurality of signalling modules can be driven separately or in any combination from predetermined receiving modules.

10. A system as defined in claim 9, further comprising terminal blocks for making connection to field wiring extending to remote sensing or alarm responding stations, and means for connecting said blocks to the connector assemblies on said functional circuit strip.

11. A system as defined in claim 9, further comprising a lamp circuit module, including a plurality of lamps responding to a variety of alarm and trouble conditions in the system.

12. A system as defined in claim 9, further comprising a buzzer at said control panel for indicating a variety of alarm and trouble conditions in the system.

13. A system as defined in claim 9, further comprising a lamp of each functional circuit module for indicating the condition on the line to which each functional circuit module is connected.

14. A system as defined in claim 9, further comprising a power and switch assembly connected to said control panel, said assembly including switch means for suppressing the indication otherwise given of an alarm or trouble condition.

* * * * *